US005599243A

United States Patent [19]

Kobayashi

[11] Patent Number: 5,599,243

[45] Date of Patent: Feb. 4, 1997

[54] GOLF CLUB HEAD WITH PERIPHERAL WEIGHT

[75] Inventor: Kenji Kobayashi, Tsubame, Japan

[73] Assignee: K. K. Endo Seisakusho, Tsubame, Japan

[21] Appl. No.: 584,947

[22] Filed: Jan. 16, 1996

Related U.S. Application Data

[62] Division of Ser. No. 250,431, May 27, 1994, Pat. No. 5,564,705.

[30] Foreign Application Priority Data

| | | | |
|---|---|---|---|
| May 31, 1993 | [JP] | Japan | 5-129627 |
| Jul. 22, 1993 | [JP] | Japan | 5-181685 |
| Oct. 4, 1993 | [JP] | Japan | 5-248195 |
| Mar. 30, 1994 | [JP] | Japan | 6-61178 |

[51] Int. Cl.[6] ..... A63B 53/04

[52] U.S. Cl. ..... 473/335

[58] Field of Search ..... 473/334, 335, 473/336, 337, 338, 339, 349, 350

[56] References Cited

U.S. PATENT DOCUMENTS

| | | | |
|---|---|---|---|
| 1,504,380 | 8/1924 | Reitenour | 473/325 |
| 1,538,312 | 5/1925 | Beat | 473/337 |
| 3,847,399 | 11/1974 | Raymont | 473/350 |
| 3,941,390 | 3/1976 | Hussey | 473/349 X |
| 3,955,820 | 5/1976 | Cochran et al. | 473/337 |
| 4,213,613 | 7/1980 | Nygren | 473/337 X |
| 4,919,431 | 4/1990 | Antonious | 473/350 |
| 5,026,056 | 6/1991 | McNally et al. | 473/350 X |
| 5,297,794 | 3/1994 | Lu | 473/337 |
| 5,333,872 | 8/1994 | Manning et al. | 473/350 X |
| 5,439,223 | 8/1995 | Kobayashi | 473/334 |

FOREIGN PATENT DOCUMENTS

| | | | |
|---|---|---|---|
| 1232651 | 5/1971 | United Kingdom | 273/171 |

*Primary Examiner*—William H. Grieb
*Attorney, Agent, or Firm*—Quarles & Brady

[57] ABSTRACT

An iron or putter golf club head which enables the enlarging of a sweet area. In a peripheral portion of a back 2*a* of a head body 11*a* made of titanium alloy is formed an embedding groove 13*a*. Into the embedding groove 13*a* is press-fitted a balance weight 12*a* of beryllium copper alloy. The balance weight 12*a* has an integral extention 16*a* extending down to a sole of the head body 11*a*. After the press-fitting process, a cavity 18*a* is formed in an area of the back 2*a* surrounded by the balance weight 12*a* by milling. Owing to the annular balance weight and the cavity provided at the back 2*a*, the weight distribution of the head is capable of being greatly concenterated on the peripheral portion of the head. In addition, the above extension 16*a* enables the lowering of the center of gravity of the head body 11*a*, thus providing a golf club head with which balls are capable of being easily controlled.

6 Claims, 7 Drawing Sheets

GOLF CLUB HEAD WITH PERIPHERAL WEIGHT

CROSS REFERENCE TO RELATED APPLICATIONS

This application is a divisional application of U.S. Ser. No. 08/250,431 filed on May 27, 1994, now U.S. Pat. No. 5,564,705.

BACKGROUND OF THE INVENTION (a) Field of the Invention

The present invention relates to a golf club head, especially relates to so-called an iron golf club head or a putter golf club head.

(b) Description of Prior Art

It is mainly for the purpose of enlarging so-called a sweet area and lowering the center of gravity of a golf club head that the weight distribution of a golf club head including an iron golf club head or the like is adjusted in an invention related to a golf club head. It is obvious to those skilled in the art that to enlarge a sweet area, the center of gravity of a club head should be positioned comparatively backward, and/or, the weight distribution of a golf club head should be concentrated upon a peripheral portiton of a main body of a head besides the enlargement of a bulk of a golf club head itself. One of the representatives of a means for realizing such weight distribution is disclosed in U.S. Pat. No. 3,847,399, in which a head body is formed hollow, or a back surface of a club head is formed with a cavity.

On the other hand, it is mainly for the purpose of making a golf ball travel more upwardly and a longer distance to lower the center of gravity of a club head.

However, especially for an iron club head, it is difficult to make the same hollow. Further, if merely provided with a cavity in a back surface of a club head made of the same material, you cannot sufficiently concentrate the weight distribution of a club head upon a peripheral portion, thus setting limits to enlargement of a sweet area.

SUMMARY OF THE INVENTION

It is, therefore, an object of the present invention to further enlarge a sweet area in a golf club head such as an iron golf club head.

It is another object of the present invention to provide a method for manufacturing a golf club head having such a larger sweet area.

According to a major feature of the present invention, a golf club head comprising a head body having a face and a back; an embedding groove formed in a peripheral portion of the back of said head body; a balance weight formed of a material denser than that of said head body, which is press-fitted into said embedding groove along a peripheral portion of the back of said head body; a cavity which is machined in an area on the back of said head body, said cavity being either provided in the area surrounded by said balance weight or enlarged to span a part of said balance weight.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE PREFERRED EMBODIMENTS

Hereinafter are described embodiments of the present invention with reference to the drawings. All of the following embodiments relate to so called an "iron" golf club head except a sixth embodiment. As to reference numbers attached to the drawings, the same portions in each embodiment are designated by using common numbers, thus the repeated description will be suitably omitted on or after the description of a second embodiment, while alphabetical small letters are attached to each reference number, thus indicating sequently the number of the embodiment.

Figure 1:
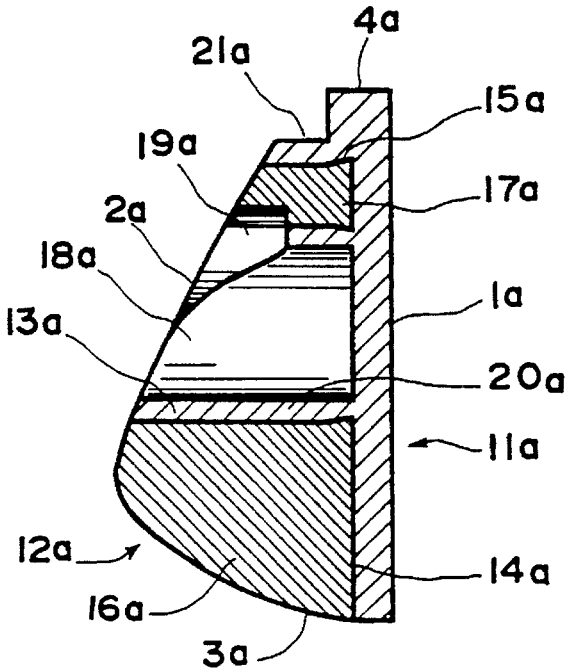
FIG. 1 is a section showing a first embodiment of a golf club head of the inveniton.
Figure 2:
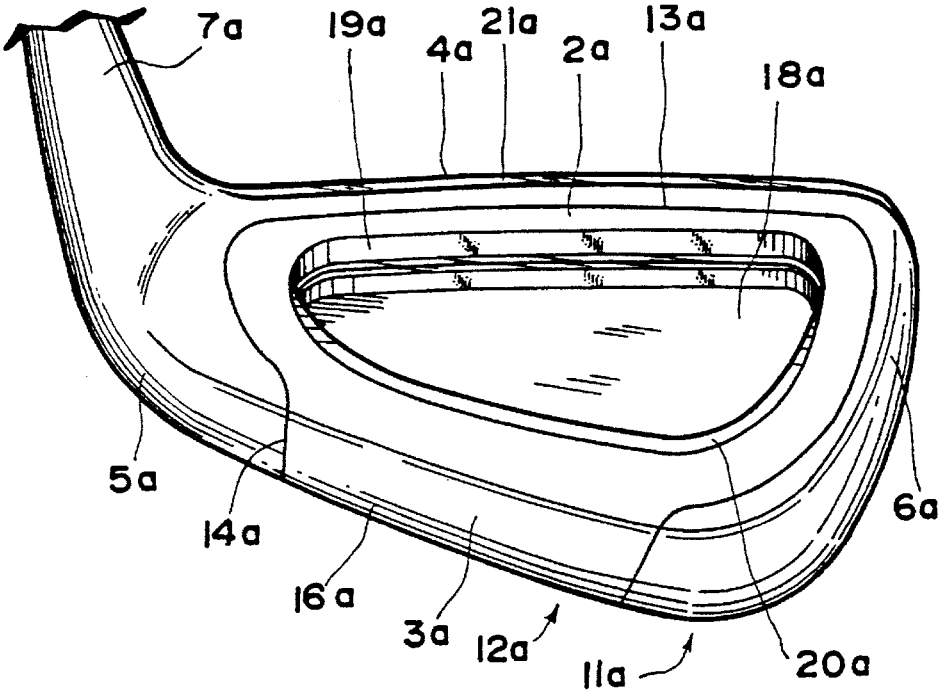
FIG. 2 is a perspective view showing a first embodiment of a golf club head of the invention.
Figure 3:
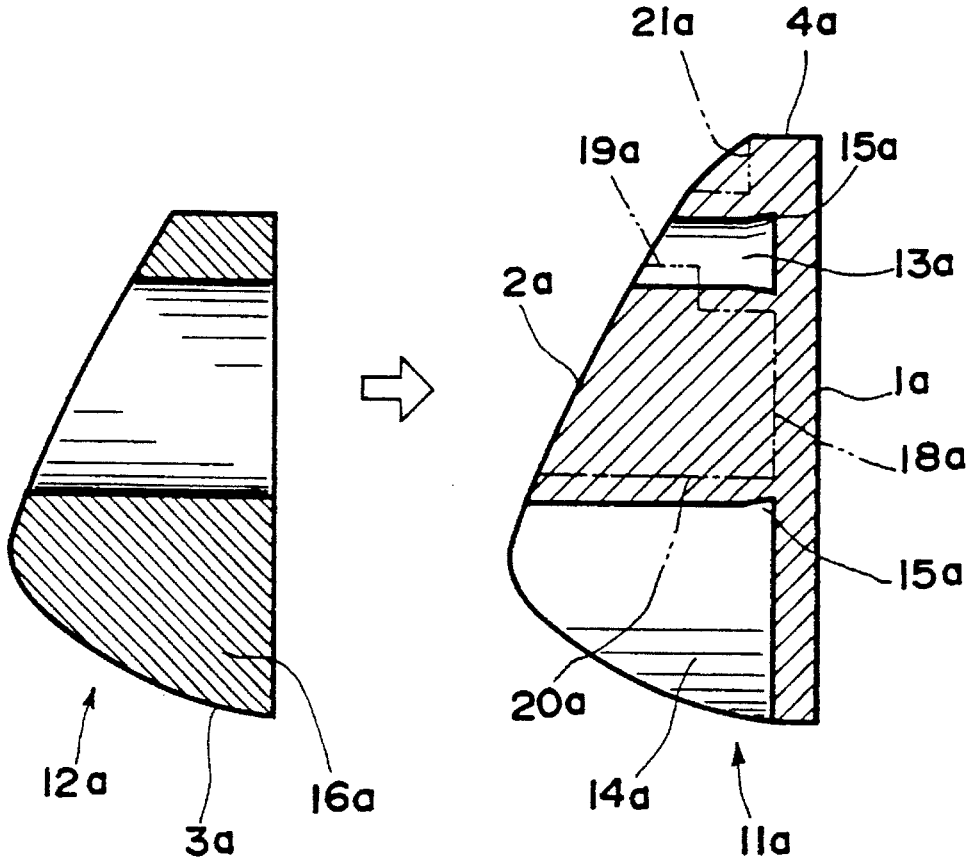
FIG. 3 is an explanatory section showing a first embodiment of a golf club head of the invention, illustrating a manufacturing method of a golf club head of the invention.

In FIGS. 1 to 3 showing a first embodiment of the ivention, a reference numeral 1*a* designates a face, 2*a* a back, 3*a* a sole, 4*a* a top, 5*a* a heel, 6*a* a toe and 7*a* a neck for conneting a shaft thereto respectively. A golf club head of the embodiment is so-called an iron-type club head, comprising a head body 11*a* and a balance weight 12*a*. The head body 11*a* is made of titanium alloy (the specific gravity approx. 4.5) which forms the aforedsaid face 1*a*, neck 7*a* and the like. The weight 12*a* is made of beryllium copper alloy (the specific gravity approx. 8.2), which forms a part of the back 2*a* and sole 3*a*.

Along a peripheral portion of the head body 11*a* at the back 2*a* side is formed an annular concave embedding groove 13*a*, which has an extension groove 14*a* extending down to the sole 3*a*. The embedding groove 13*a* is dovetail-shaped, as designated 15*a*, tapering in the front-to-back direction. Into the embedding groove 13*a* is press-fitted the annular weight 12*a*. Thus, the annular weight 12*a* is firmly secured to the head body 11*a* by the mortise/tennon joint. Corresponding to the above structure of the embedding groove 13*a*, the annular weight 12*a* has a weight-sole portion 16*a* at a lower side to be fitted into the extension groove 14*a* of the embedding groove 13*a*, thus forming the sole 3*a* of the head. Likewise, a distal end of the weight 12*a* is widened, as designated a widened portion 17*a* to be fitted into the dovetail-shaped portion 15*a* of the embedding groove 13*a*, thereby ensuring the firm securing of the head body 11*a* to the weight 12*a*.

In a preferred form of the invention, an area on the back 2*a* surrounded by the annular weight 12*a* is formed with a concave cavity 18*a*. Additionally, there is provided an extension recess 19*a* above said cavity 18*a* at the back 2*a* of the head body 11*a*, which spans across a part of said weight 12*a*, while there is provided a cover portion 20*a* contacting an inner surface of the weight 12*a*, said cover portion 20*a* being integral with the head body 11*a*. In addition, above the weight 12*a* is provided a step-formed recess 21*a* at the back 2*a* side of the head body 11*a*.

Now the method for manufacturing the above-structured golf club head will be described with reference to FIG. 3.

The head body 11*a* is basically formed by forging process, and either at the same time or after that, the embedding groove 13*a* is formed by machining. In the same manner, the weight 12*a* is formed by forging. Then, as illustrated in an arrow, the weight 12*a* is pressed into the embedding groove 13*a* of the head body 11*a*. During such press-in process, the distal end of the weight 12*a* is subjected to a plastic deformation, thus forming widened portion 17*a* to be fitted into the dovetail portion 15*a* of the embedding groove 13*a*. After the above press-in process, the cavity 18*a*, the extension recess 19*a* and the step-formed recess 21*a* are each formed by milling with the use of a machining center, as shown in a dotted line. At this stage, the amount removed by milling is approximately 20*g*.

According to the structure shown in a first embodiment, as the weight 12*a* made of beryllium copper alloy is embedded in the peripheral portion at the back 2*a* side of the head body 11*a* made of titanium alloy with the cavity 18*a* provided in the center of the back 2*a* thereof, the weight distribution of the whole head can be greately concentrated on the peripheral portion thereof and be shifted backwards relative to the face 1*a*, with the whole weight of the club head being kept within a regular value, thus greatly enlarging a sweet area. Furthermore, as the weight 12*a* forms the sole 3*a*, the center of gravity of the whole head can be positioned still lowerly and backwards. In addition, owing to the extension recess 19*a* and the step-formed recess 21*a* each provided at an upper part of the head body 11*a*, the center of gravity of the whole head can be still lowered, which allows the balls to travel more steadily and easily upward and a longer distance. As a result, a golf club head with which balls can be more easily controlled can be provided.

In addition, as the cavity 18*a* is formed by machining after the press-fitting of the weight 12*a* into the embedding groove 13*a* of the head body 11*a*, the cover portion 20*a* of the head body 11*a* contacting the inner periphery of the weight 12*a* can be formed thinner, thus enabling the enlarging of the cavity 18*a*. That is because: assuming that a cavity is pre-formed at the back side of a head body prior to the embedding of a weight, a cover portion between a cavity and an embedding groove must be thickened to a certain degree in terms of its strength.

Accordingly, a cavity cannot be sufficiently enlarged. However, in this embodiment, the cavity 18*a* can be provided so as to be as close to the weight 12*a* as you like by machining the same after the press-fitting of the weight 12*a*. Therefore, such enlargement of the cavity 18*a* makes the aforesaid weight distribution more effective. Further, the adjustment of the machining position or amount realizes the easy adjustment of the weight distribution of a club head in fabrication.

Incidentally, the same method can be applied to each embodiment described below.

Figure 4:
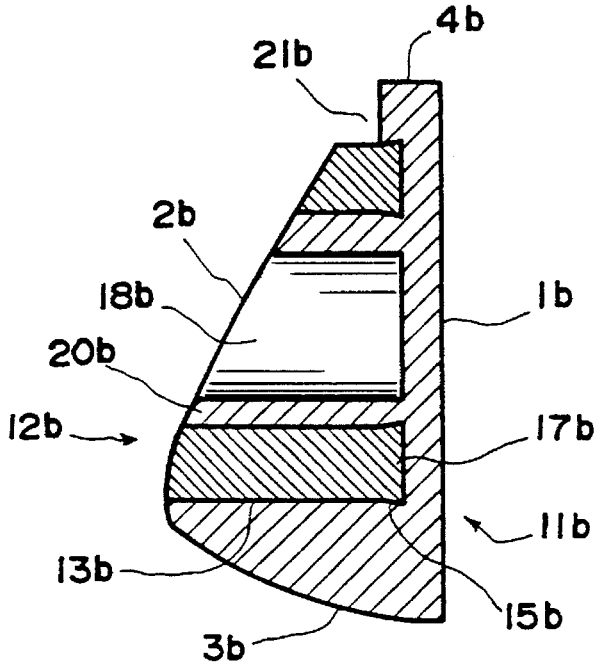
FIG. 4 is a section showing a second embodiment of a golf club head of the invention.
Figure 5:
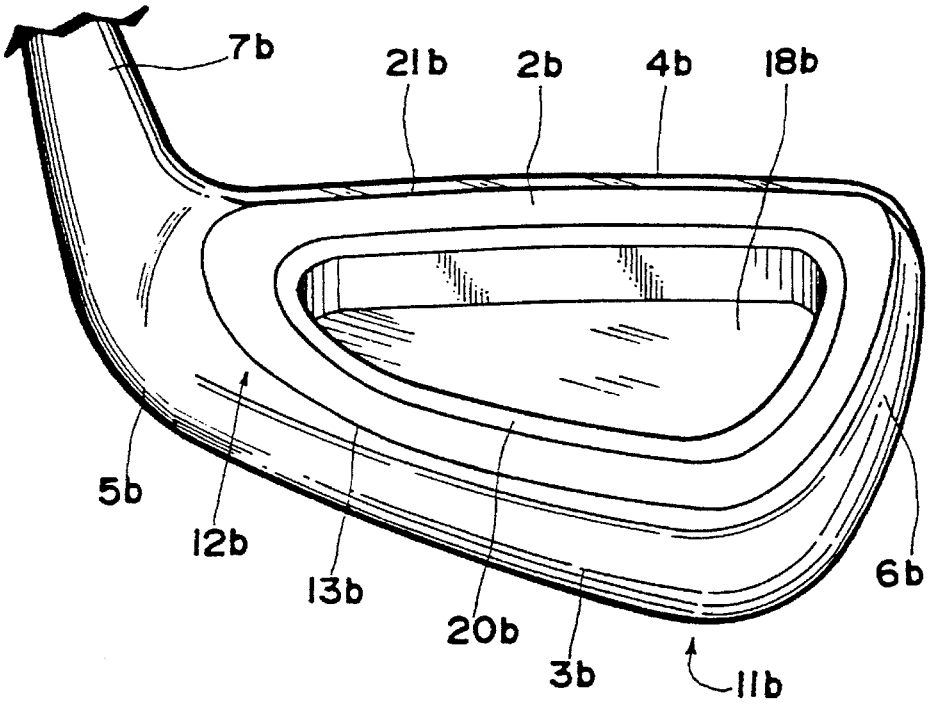
FIG. 5 is a perspective view showing a second embodiment of a golf club head of the invention.

In FIGS. 4 and 5 showing a second embodiment of the invention, a sole 3*b* is formed by a head body 11*b*, not by an annular weight 12*b*. Like a first embodiment, a cavity 18*b* and a step-formed recess 21*b* are each machined after the press-fitting of the weight 12*b* into the head body 11*b*. Though the center of gravity can be lowered further in accordance with a first embodiment, a second embodiment is advantageous in that as the weight 12*b* and embedding groove 13*b* are more simply shaped, they can be more easily machined.

Figure 6:
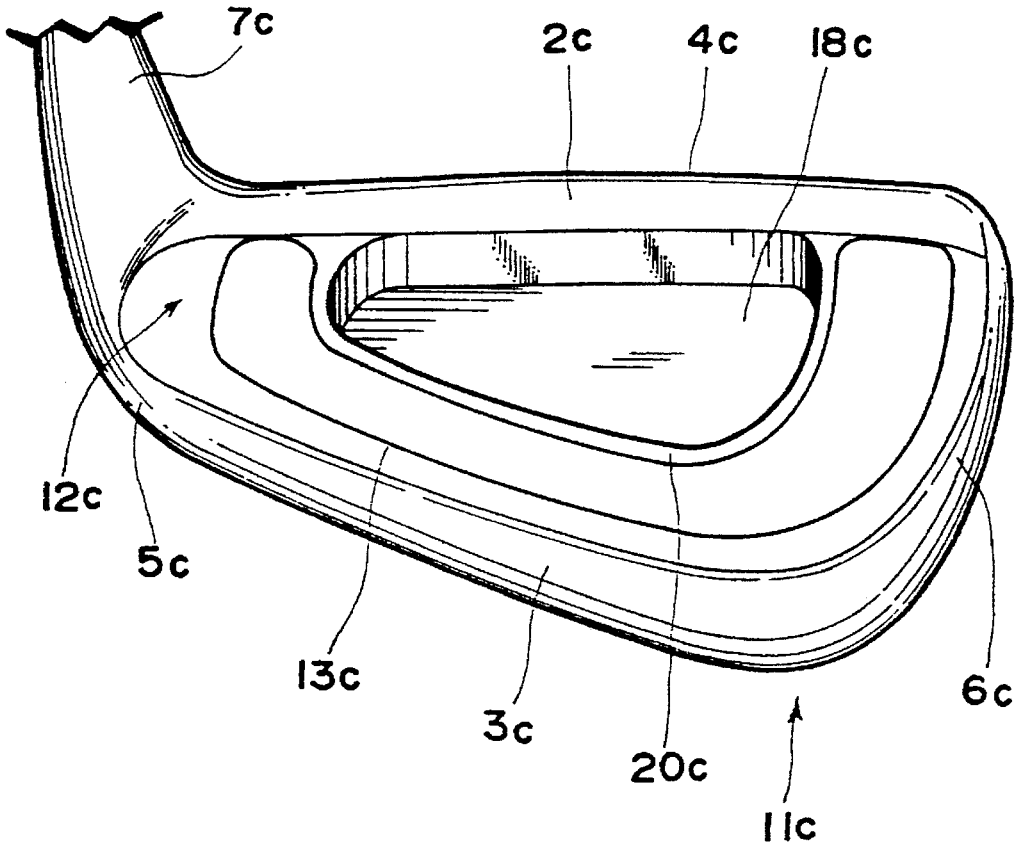
FIG. 6 is a perspective view showing a third embodiment of a golf club head of the invention.

In FIG. 6 showing a third embodiment, both an embedding groove 13*c* and a weight 12*c* are each formed semi-annular, which are provided along a sole 3*c*, heel 5*c* and toe 6*c* sides only, not including top 4*c* side. Thus, the center of gravity of the whole head can be relatively lowered and positioned backwards.

Figure 7:
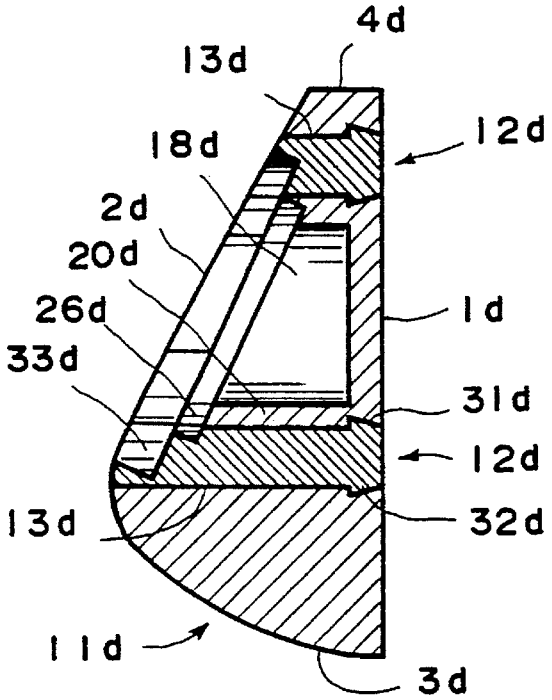
FIG. 7 is a section showing a fourth embodiment of a golf club head of the invention.
Figure 8:
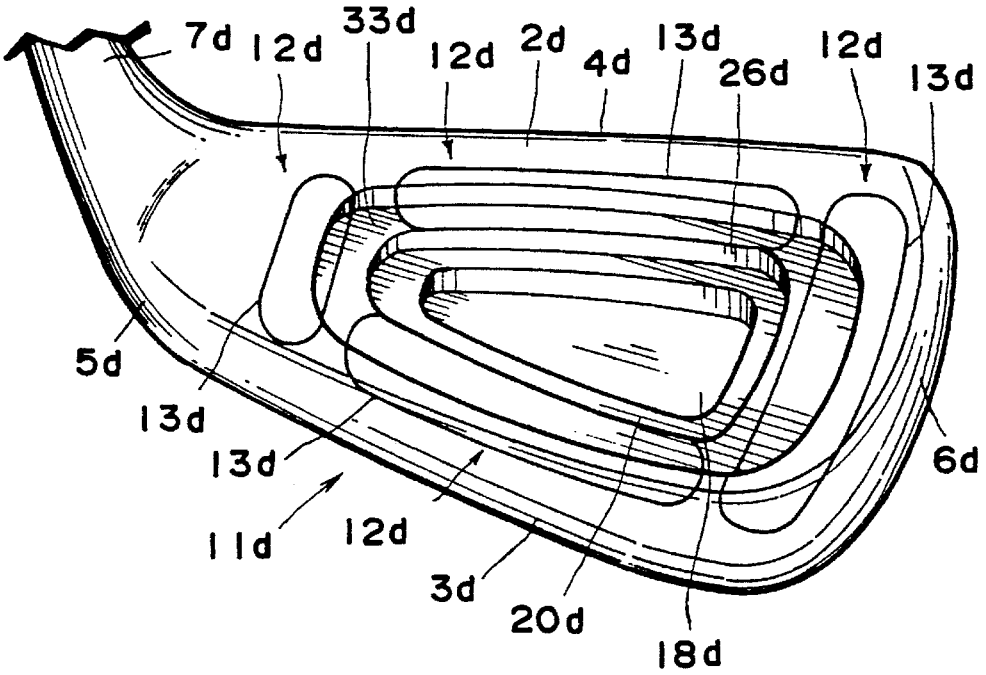
FIG. 8 is a perspective view showing a fourth embodiment of a golf club head of the invention.

In FIGS. 7 to 8 showing a fourth embodiment of the invention, a weight 12*d* is divided into four parts at a sole 3*d*, a top 4*d*, a heel 5*d* and a toe 6*d* sides respectively. Four weights designated at the same numeral are formed tabular respectively. On the other hand, four embedding grooves 13*d* corresponding to the four weights 12*d* penetrate from a back 2*d* of a head body 11*d* through a face 1*d* thereof. As shown in FIG. 7, there is provided wedge-shaped portion 31*d* of each embedding groove 12*d* adjacent the face 1*d* side. Each of the wedge-shaped portions 31*d* has a vertical surface at its back, while it tapers in the back-to-front direction so that a wedge portion 32*d* at a distal end of the weight 12*d* may be fitted into the corresponding embedding groove for preventing the weight 12*d* from being loosened. Further, a cavity 18*d* provided at a back 2*d* side of the head body 11*d* has wide recesses 26*d* and 33*d*, thus providing two-step-formed recesses in this embodiment. In fabrication, each weight 12*d* is press-fitted from the back into each corresponding embedding groove 13*d* of the head body 11*d*. At this time, each weight 12*d* is struck at a support plate (not shown) provided at the face 1*d* side, whereby the distal end of the weight 12*d* is subjected to a plastic deformation to form the wedge-shaped portion 32*d* fitted into each wedge-shaped portion 31*d* of each embedding groove 13*d*. The cavity 18*d*, of course, is machined thereafter.

According to the structure shown in a fourth embodiment, as each weight 12*d* penetrates from the back 2*d* through the face 1*d*, the weight distribution of the club head can be still concentrated upon the peripheral portion relative to the face 1*d*.

Figure 9:
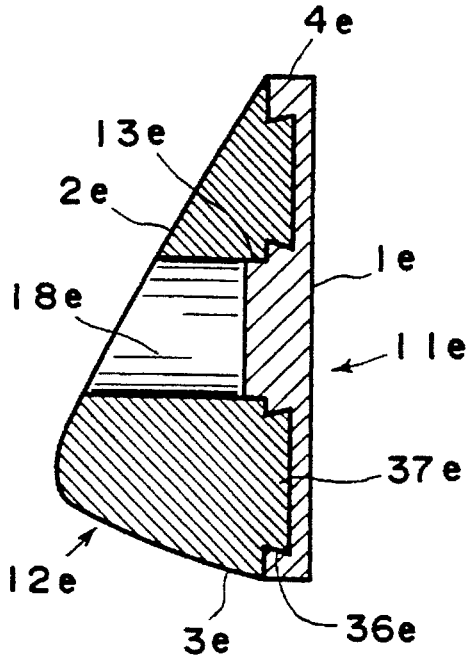
FIG. 9 is a section showing a fifth embodiment of a golf club head of the invention.
Figure 10:
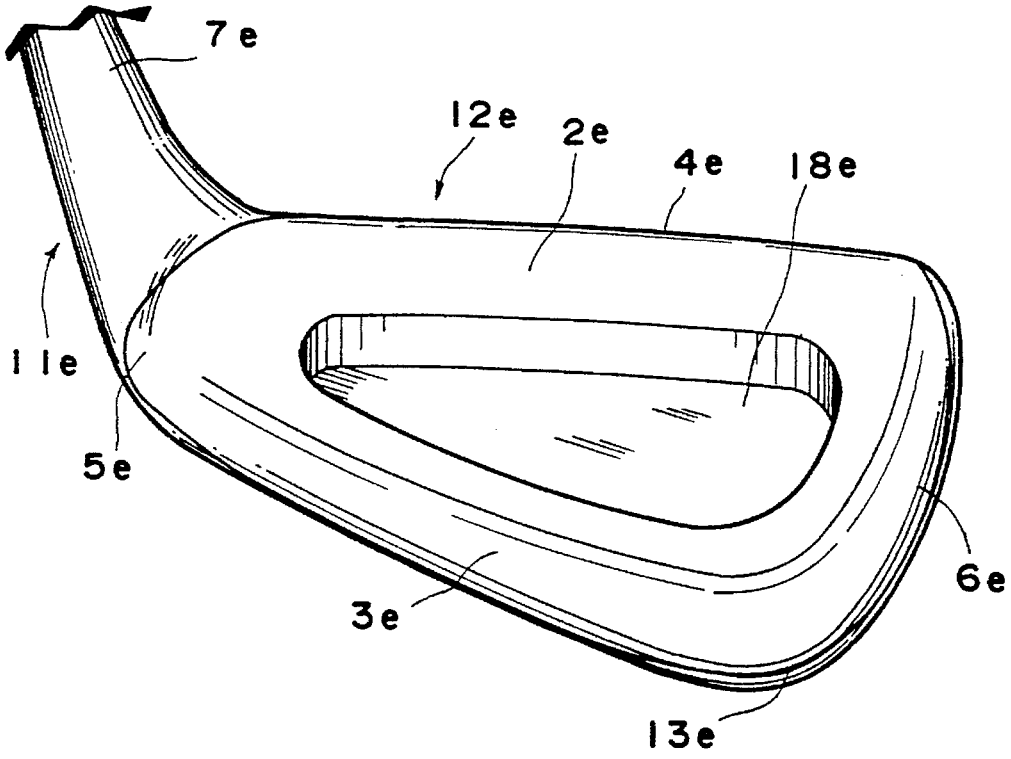
FIG. 10 is a perspective view showing a fifth embodiment of a golf club head of the invention.

In FIGS. 9 to 10 showing a fifth embodiment of the inventon, nearly a whole portion of a back 2*e* side of a club head including a sole 3*e* is constructed by an annular weight 12*e*. To ensure such structure, an embedding groove 13*e* for press-fitting of the weight 12*e* thereinto is step-formed at a peripheral portion of the back 2*e* side of the head body 11*e*. In addition, to firmly secure the weight 12*e* to the head body 11*e*, there is provided a dovetail groove 36*e* provided in a bottom surface of the embedding groove 13*e*, into which is press-fitted a protrusion 37*e* formed on a front surface of the weight 13*e* with the same being subjected to a plastic deformation.

Like the foregoing embodiments, a cavity 18*e* is formed by machining process after the press-fitting of the weight 12*e* into the head body 11*e*. However, unlike the foregoing embodiments, the cavity 18*e* is formed by removing the entire area of the back 2*e* surrounded by the annular weight 12*e*, so that there remains no cover portion contacting an inner peripheral surface of the weight 12*e* descirbed in the foregoing embodiments.

With the structure thus made, as approximately a whole poriton of the back 2*e* side of the club head is constructed by the annular weight 12*e*, the center of gravity of the head can be positioned further backward, and the weight distribution thereof can be further concentrated upon its peipheral portion.

Figure 11:
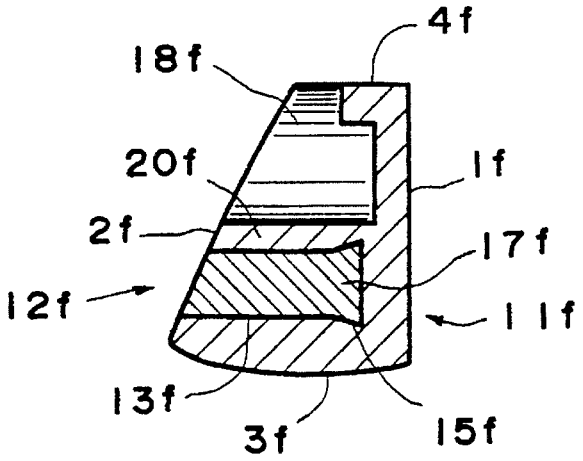
FIG. 11 is a section showing a sixth embodiment of a golf club head of the invention.
Figure 12:
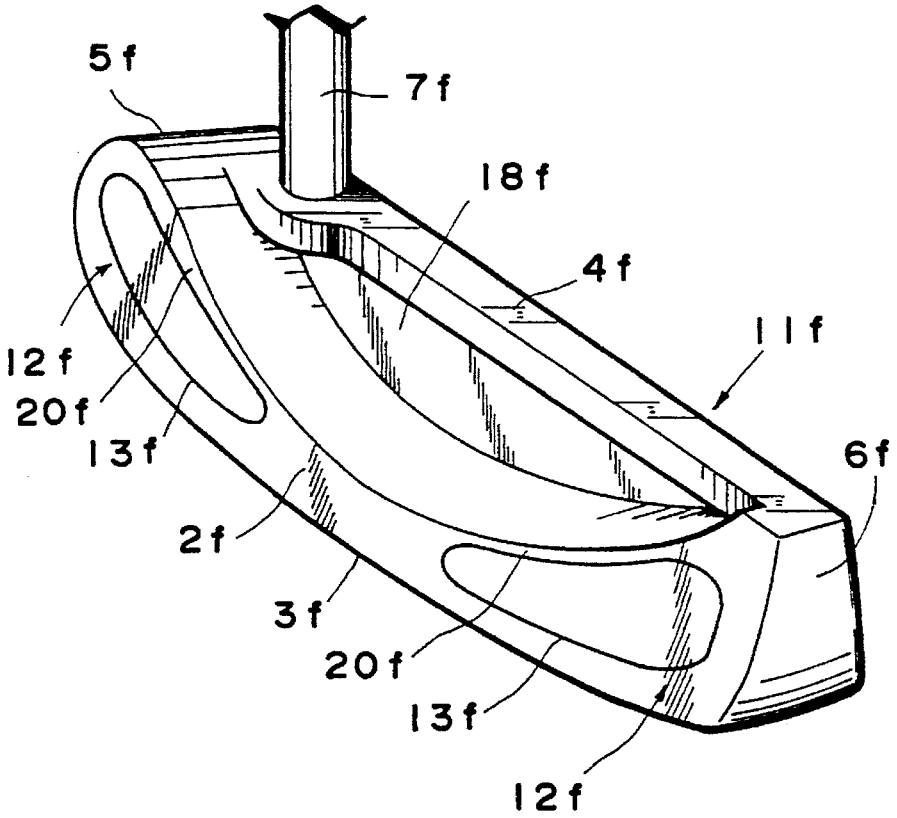
FIG. 12 is a perspective view showing a sixth embodiment of a golfclub head of the invention.

In FIGS. 11 to 12 showing a sixth embodiment of the invention, the above-mentioned structures described in the foregoing embodiments are applied to a putter golf club head. In a back 2*f* adjacent a sole 3*f* side of a head body 11*f* are provided two weights 12*f*, one of which is provided at a heel 5*f* side, while the other at a toe 6*f* side. Thereafter, between the weights 12*f* is formed a cavity 18*f*.

Incidentally, the present invention should not be limited to the foregoing embodiments, but may be modified within a scope of the invention. For example, the material of the head body may be other metallic material such as aluminium or pure titainium other than titanium alloy. Furthermore, the material of the weights may be comparatively denser metallic material such as copper alloy or stainless steel (the specific gravity approx. 7.9) other than beryllium copper alloy. In addition, any suitable configurations of the whole head may be chosen.

What is claimed:

1. A golf club head comprising:

a head body having a face and a back;

an embedding groove formed in a peripheral portion of the back of said head body;

a balance weight formed of a material denser than that of said head body, which is press-fitted into said embedding groove along a peripheral portion of the back of said head body;

a cavity which is machined in an area on the back of said head body, said cavity being provided in the area surrounded by said balance weight.

2. A golf club head according to claim 1, wherein said balance weight has an integral extension which extends down to a sole side of the head body to form the sole portion of the head body.

3. A golf club head according to claim 1, wherein said balance weight is formed semi-annular and provided at a toe, heel and sole sides only.

4. A golf club head comprising:

a head body having a face and a back;

an embedding groove formed in a peripheral portion of the back of said head body;

a balance weight formed of a material denser than that of said head body, which is press-fitted into said embedding groove along a peripheral portion of the back of said head body;

a cavity which is machined in an area on the back of said head body, said cavity being enlarged to span a part of said balance weight.

5. A golf club head according to claim 4, wherein said balance weight has an integral extension which extends down to a sole side of the head body to form the sole portion of the head body.

6. A golf club head according to claim 4, wherein said balance weight is formed semi-annular and provided at a toe, heel and sole sides only.

* * * * *